US011561497B2

(12) United States Patent
Saito et al.

(10) Patent No.: US 11,561,497 B2
(45) Date of Patent: Jan. 24, 2023

(54) CLEANING DEVICE CAPABLE OF PREVENTING SOLIDIFICATION OF TONER AND IMAGE FORMING APPARATUS INCLUDING THE SAME

(71) Applicant: KYOCERA Document Solutions Inc., Osaka (JP)

(72) Inventors: Yosuke Saito, Osaka (JP); Ai Takagami, Osaka (JP); Nobuyuki Hayashi, Osaka (JP); Masaki Kadota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/693,134

(22) Filed: Mar. 11, 2022

(65) Prior Publication Data

US 2022/0308518 A1 Sep. 29, 2022

(30) Foreign Application Priority Data

Mar. 26, 2021 (JP) ..... JP2021-053186

(51) Int. Cl.
*G03G 21/00* (2006.01)

(52) U.S. Cl.
CPC ..... *G03G 21/0011* (2013.01)

(58) Field of Classification Search
CPC ..... G03G 21/10; G03G 21/105
USPC ..... 399/358
See application file for complete search history.

(56) References Cited

U.S. PATENT DOCUMENTS

| | | | | |
|---|---|---|---|---|
| 9,996,046 | B2 * | 6/2018 | Oi | G03G 21/105 |
| 2022/0308501 | A1 * | 9/2022 | Kadota et al. | G03G 15/105 |
| 2022/0308519 | A1 * | 9/2022 | Takagami et al. | G03G 21/0011 |

FOREIGN PATENT DOCUMENTS

| | | | |
|---|---|---|---|
| JP | 4-172484 | A | 6/1992 |
| JP | 2008-158170 | A | 7/2008 |

* cited by examiner

*Primary Examiner* — William J Royer
(74) *Attorney, Agent, or Firm* — Stein IP LLC

(57) ABSTRACT

A cleaning device includes a housing, a cleaning blade, a toner conveyance path, a conveyance screw, a first flicker, and a second flicker. The conveyance screw includes a rotary shaft and a helical vane. The first flicker includes a first base portion and a plurality of first contact pieces. The second flicker includes a second base portion and a plurality of second contact pieces. An inclination angle θ1 has a value between an inclination angle θ2 and an inclination angle θ3.

5 Claims, 4 Drawing Sheets

CLEANING DEVICE CAPABLE OF PREVENTING SOLIDIFICATION OF TONER AND IMAGE FORMING APPARATUS INCLUDING THE SAME

INCORPORATION BY REFERENCE

This application is based upon and claims the benefit of priority from the corresponding Japanese Patent Application No. 2021-053186 (filed on Mar. 26, 2021), the entire contents of which are incorporated herein by reference.

BACKGROUND

The present disclosure relates to a cleaning device and an image forming apparatus including the same.

In an image forming apparatus (a copy machine, a printer, a facsimile, or the like) using an electrophotographic method, an electrostatic latent image formed on an image carrier (a photosensitive drum or the like) is developed into a visual toner image by using toner (a powdery developer) in a developing device, and this toner image is transferred onto a recording medium directly or via an intermediate transfer member and then is subjected to fixing processing. In the image forming apparatus thus configured, there is mounted a cleaning device for removing residual toner on a surface of the image carrier or the intermediate transfer member.

The cleaning device described above includes a toner removing mechanism, a housing, and a conveyance screw. The toner removing mechanism removes residual toner on the surface of the image carrier. In the housing, there is formed a toner conveyance path for conveying waste toner removed. The conveyance screw conveys waste toner in the toner conveyance path to a waste toner collection container provided outside the housing. The housing has an opening that is formed at a position thereon overlapping the surface of the image carrier and through which waste toner is introduced into the toner conveyance path.

Meanwhile, there is a fear that when subjected to mechanical stress, waste toner might become uneven in terms of its particle shape and the degree of adhesion of an external additive thereto, thus deteriorating in flowability. Moreover, intrusion of paper dust or the like into waste toner might cause the waste toner to further deteriorate in flowability and thus become likely to be solidified. Furthermore, with toner having lower melting points in recent years, flowability of the toner is more likely to be decreased under a high-temperature environment. This has led to a problem that, particularly in a high-temperature and high-humidity environment, waste toner having decreased flowability might be solidified around the conveyance screw (for example, between helical blades) provided in the toner conveyance path, bringing about a so-called blocking state in which toner can hardly be conveyed.

To address this problem, various methods for suppressing the blocking state brought about by waste toner have been proposed, an example of which uses a cleaning device adopting a configuration in which a flicker in the shape of a plurality of films is made to abut on a conveyance screw.

The flicker is provided over an entire region of the conveyance screw in an axis direction thereof. The flicker abuts on the conveyance screw and presses, at a location of the abutment, the conveyance screw toward a bottom part of a toner conveyance path. As the conveyance screw rotates, the flicker assumes, in a repeated and reciprocating manner, a state of being lifted by the helical blades of the conveyance screw to be elastically deformed and a state of abutting on a rotary shaft of the conveyance screw under resilience and thus swings while being elastically deformed correspondingly to a rotation cycle of the rotary shaft. The conveyance screw rotates in a state where the flicker abuts thereon in this manner, so that waste toner adhering to the conveyance screw is scraped off by the flicker, thus being unlikely to stick to the conveyance screw.

In the cleaning device, however, on an outer circumferential surface of the conveyance screw, there exists a location at which the flicker does not abut on the conveyance screw, namely, a dead space. This leads to a fear that toner might remain adhering to the dead space and stick thereto, causing degradation in conveyance capability. Furthermore, if an increased number of flickers are used to reduce such a dead space, there is also a fear that waste toner introduced through an opening might be blocked by the flickers from being introduced into the toner conveyance path, rather causing degradation in toner conveyance capability.

In contrast, there is a cleaning device including two flickers that are a first flicker and a second flicker. The first flicker and the second flicker are in contact with each other and, at respective positions thereon nearer to distal ends thereof than a location of the contact is, abut on and press a conveyance screw. The two flickers abut on the conveyance screw, and thus the above-described dead space is narrowed, so that toner on a surface of the conveyance screw can be scraped off more efficiently.

A cleaning device according to one aspect of the present disclosure includes a housing, a cleaning blade, a toner conveyance path, a conveyance screw, a first flicker, and a second flicker. The housing has an opening that is formed so as to overlap an outer circumferential surface of an image carrier and through which waste toner removed from the outer circumferential surface of the image carrier is introduced inside the housing. The cleaning blade protrudes through the opening toward the outer circumferential surface of the image carrier and has a distal end part that abuts on the outer circumferential surface of the image carrier. The toner conveyance path is provided in a bottom part of the housing and conveys the waste toner introduced through the opening. The conveyance screw includes a rotary shaft rotatably supported inside the toner conveyance path and a helical vane formed on an outer circumferential surface of the rotary shaft. The first flicker includes a first base portion extending in a direction of the rotary shaft and a plurality of first contact pieces extending from the first base portion toward the conveyance screw to abut on an upper part of an outer circumferential surface of the conveyance screw relative to the rotary shaft and arranged along the rotary shaft direction. The first flicker uses the first contact pieces to press the conveyance screw in a first direction toward a bottom part of the toner conveyance path. The second flicker includes a second base portion extending in the rotary shall direction and a plurality of second contact pieces extending from the second base portion toward the conveyance screw to abut on a lower part of the outer circumferential surface of the conveyance screw relative to the rotary shaft and arranged along the rotary shaft direction. The second flicker uses the second contact pieces to press the conveyance screw in a second direction opposite to the first direction. An inclination angle θ1 of an action line of a resultant force of respective pressing forces of the first flicker and the second flicker with respect to the rotary shaft in a prescribed turn direction with respect to a perpendicular direction has a value between an inclination angle θ2 of a normal, with respect to the perpendicular direction, to a first tangent of a pair of tangents passing through the distal end part of the cleaning blade and the outer circumferential surface of the conveyance screw, the first tangent being on a side near the first flicker, and an inclination angle θ3 of a normal, with respect to the perpendicular direction, to a second tangent of the pair of tangents, the second tangent being on a side near the second flicker.

DETAILED DESCRIPTION

Figure 1:
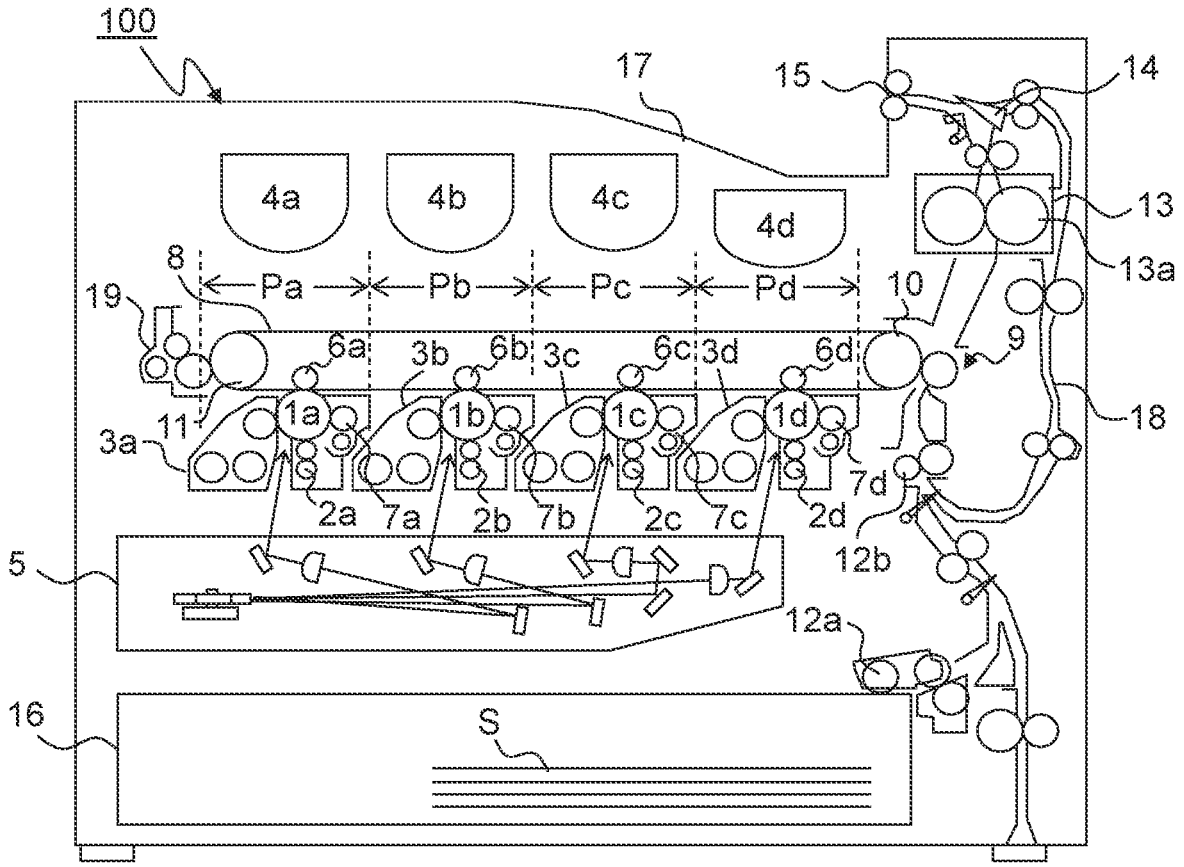
FIG. 1 is a schematic sectional view of an image forming apparatus in which a cleaning device of the present disclosure is mounted.

With reference to the appended drawings, the following describes a first embodiment of cleaning devices 7*a* to 7*d* of the present disclosure and an image forming apparatus 100, FIG. 1 is a schematic sectional view of the image forming apparatus 100 in which the cleaning devices 7*a* to 7*d* of the present disclosure are mounted. In a main body of the image forming apparatus 100, four image forming portions Pa, Pb, Pc, and Pd are arranged in order from an upstream side (a left side in FIG. 1) in a conveyance direction. The image forming portions Pa to Pd are provided so as to correspond to images of four different colors (magenta, cyan, yellow, and black) and individually perform steps of charging, exposure, development, and transfer so as to sequentially form images of magenta, cyan, yellow, and black, respectively.

In the image forming portions Pa to Pd, photosensitive drums 1*a*, 1*b*, 1*c*, and 1*d* (image carriers) are provided, respectively, to carry visible images (toner images) of the respective colors. Moreover, an intermediate transfer belt 8 that rotates in a counterclockwise direction in FIG. 1 is provided adjacently to the image forming portions Pa to Pd. Toner images formed respectively on the photosensitive drums 1*a* to 1*d* are sequentially transferred onto the intermediate transfer belt 8 moving while abutting on the photosensitive drums 1*a* to 1*d* and then are transferred at a time onto a sheet S as an example of a recording medium in a secondary transfer unit 9. Moreover, the toner images are fixed on the sheet S in a fixing portion 13, and then the sheet S is discharged from the main body of the image forming apparatus 100. An image forming process with respect to the photosensitive drums 1*a* to 1*d* is executed while the photosensitive drums 1*a* to 1*d* are rotated in a clockwise direction in FIG. 1.

The sheet S on which toner images are to be transferred is contained in a sheet cassette 16 disposed in a lower part in the image forming apparatus 100 and is conveyed to the secondary transfer unit 9 via, a paper feed roller 12*a* and a registration roller pair 12*b*.

Next, a description is given of an image forming procedure performed in the image forming apparatus 100. Upon an instruction to start image formation being inputted by a user, first, the photosensitive drums 1*a* to 1*d* are started to rotate by a main motor (not shown), and a surface of each of the photosensitive drums 1*a* to 1*d* is uniformly charged by a charging roller 21 (see FIG. 2) of a corresponding one of charging devices 2*a* to 2*d*. Then, electrostatic latent images corresponding to an image signal are formed on the photosensitive drums 1*a* to 1*d*, respectively, by beam light (laser light) emitted from an exposure device 5.

Developing devices 3*a* to 3*d* are filled with prescribed amounts of toner of the respective colors of magenta, cyan, yellow, and black, respectively. In a case where a percentage of toner in a two-component developer filled in each of the developing devices 3*a* to 3*d* falls below a preset value due to after-mentioned toner image formation, the developing devices 3*a* to 3*d* are replenished with toner from toner containers 4*a* to 4*d*, respectively. The toner in the developer is supplied on each of the photosensitive drums 1*a* to 1*d* by a developing roller 25 (see FIG. 2) of a corresponding one of the developing devices 3*a* to 3*d* and electrostatically adheres thereto. Thus, there are formed toner images corresponding to the electrostatic latent images on the photosensitive drums 1*a* to 1*d*, respectively.

Further, each of primary transfer rollers 6*a* to 6*d* applies an electric field at a prescribed transfer voltage between itself and a corresponding one of the photosensitive drums 1*a* to 1*d* so that the toner images of magenta, cyan, yellow, and black on the photosensitive drums 1*a* to 1*d* are primarily transferred onto the intermediate transfer belt 8. These images of the four different colors are formed in a prescribed positional relationship predetermined for formation of a prescribed full-color image. After that, residual toner remaining on the surface of each of the photosensitive drums 1*a* to 1*d* is removed by a cleaning blade 28 (see FIG. 2) of a corresponding one of the cleaning devices 7*a* to 7*d* in preparation for subsequent formation of a new electrostatic latent image.

When the intermediate transfer belt 8 starts to rotate in the counterclockwise direction as a driving roller 10 is driven to rotate by a belt driving motor (not shown), at prescribed timing, the sheet S is conveyed from the registration roller pair 12*b* to the secondary transfer unit 9 provided adjacently to the intermediate transfer belt 8, where a full-color image is transferred on the sheet S. The sheet S on which toner images have been transferred is conveyed to the fixing portion 13. Residual toner remaining on a surface of the intermediate transfer belt 8 is removed by a belt cleaning unit 19.

The sheet S thus conveyed to the fixing portion 13 is heated and pressed by a fixing roller pair 13*a* so that the toner images are fixed on a surface of the sheet S. and thus a prescribed full-color image is formed thereon. A conveyance direction of the sheet Son which the full-color image has been formed is controlled by a branch portion 14 branching off in a plurality of directions, and thus the sheet S is directly (or after being conveyed to a double-sided conveyance path 18 and subjected to double-sided printing therein) discharged to a discharge tray 17 by a discharge roller pair 15.

Figure 2:
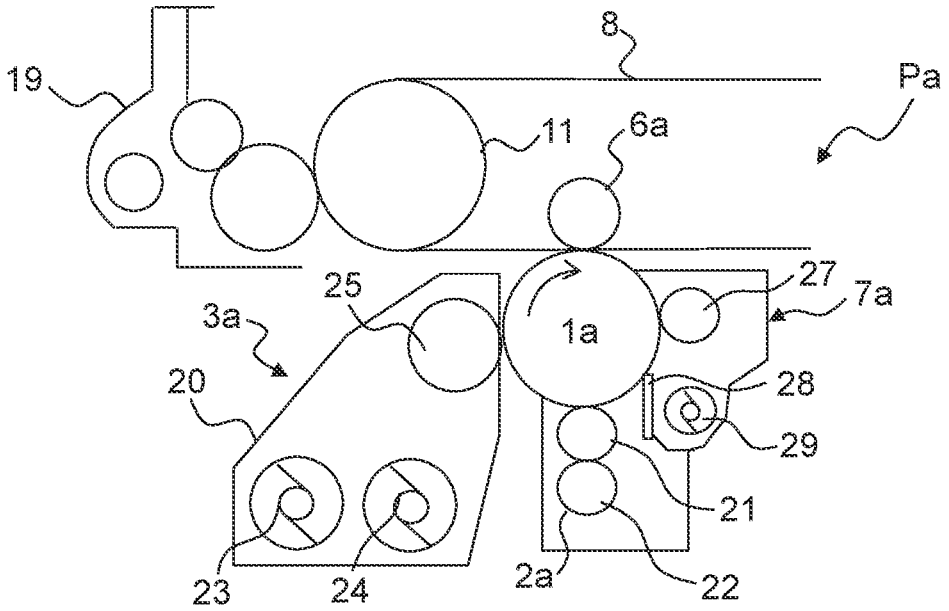
FIG. 2 is an enlarged view of a vicinity of an image forming portion shown in FIG.
Figure 3:
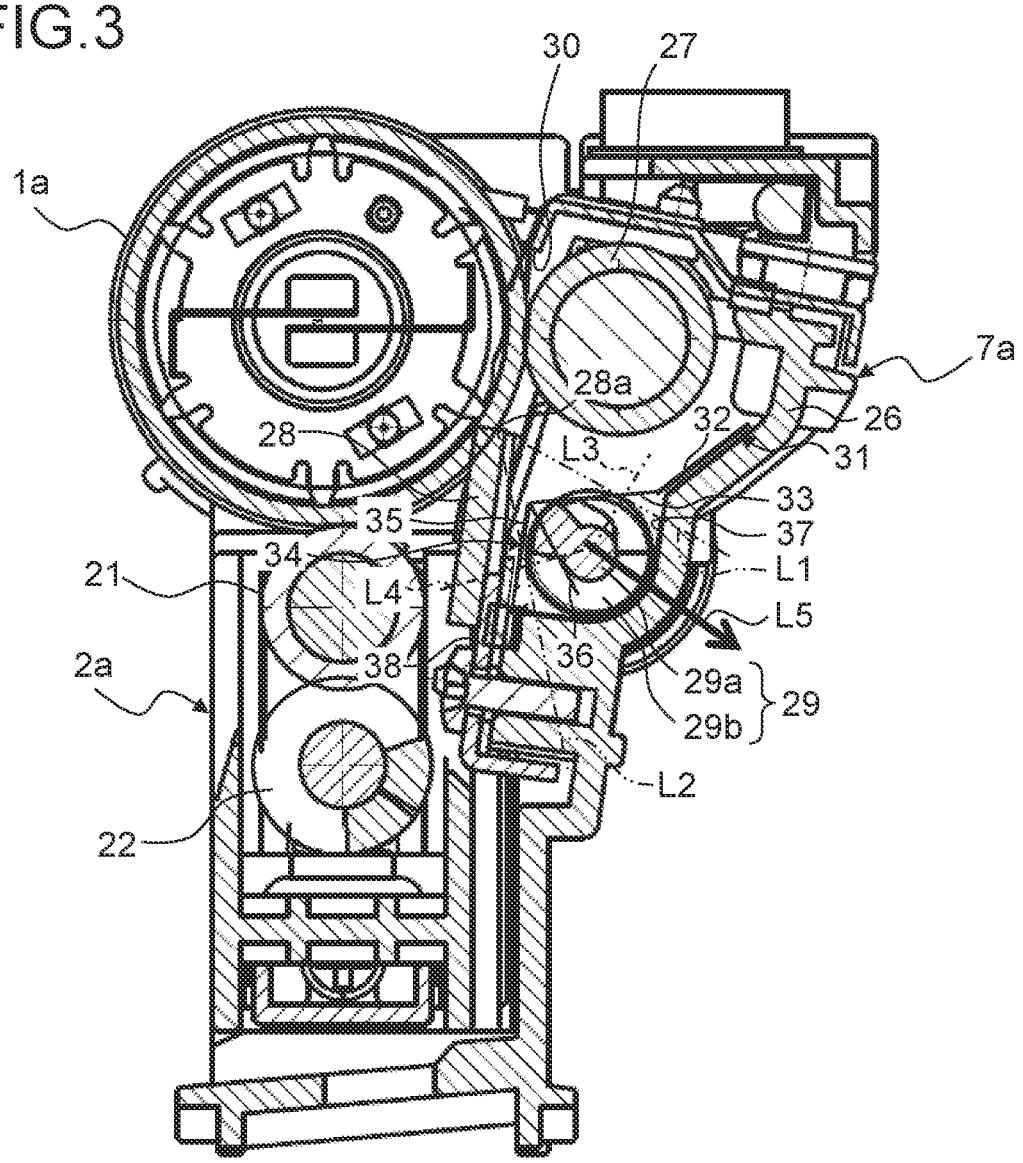
FIG. 3 is a side sectional view showing a configuration of surroundings of a cleaning device according to an embodiment of the present disclosure shown in FIG. 2.
Figure 4:
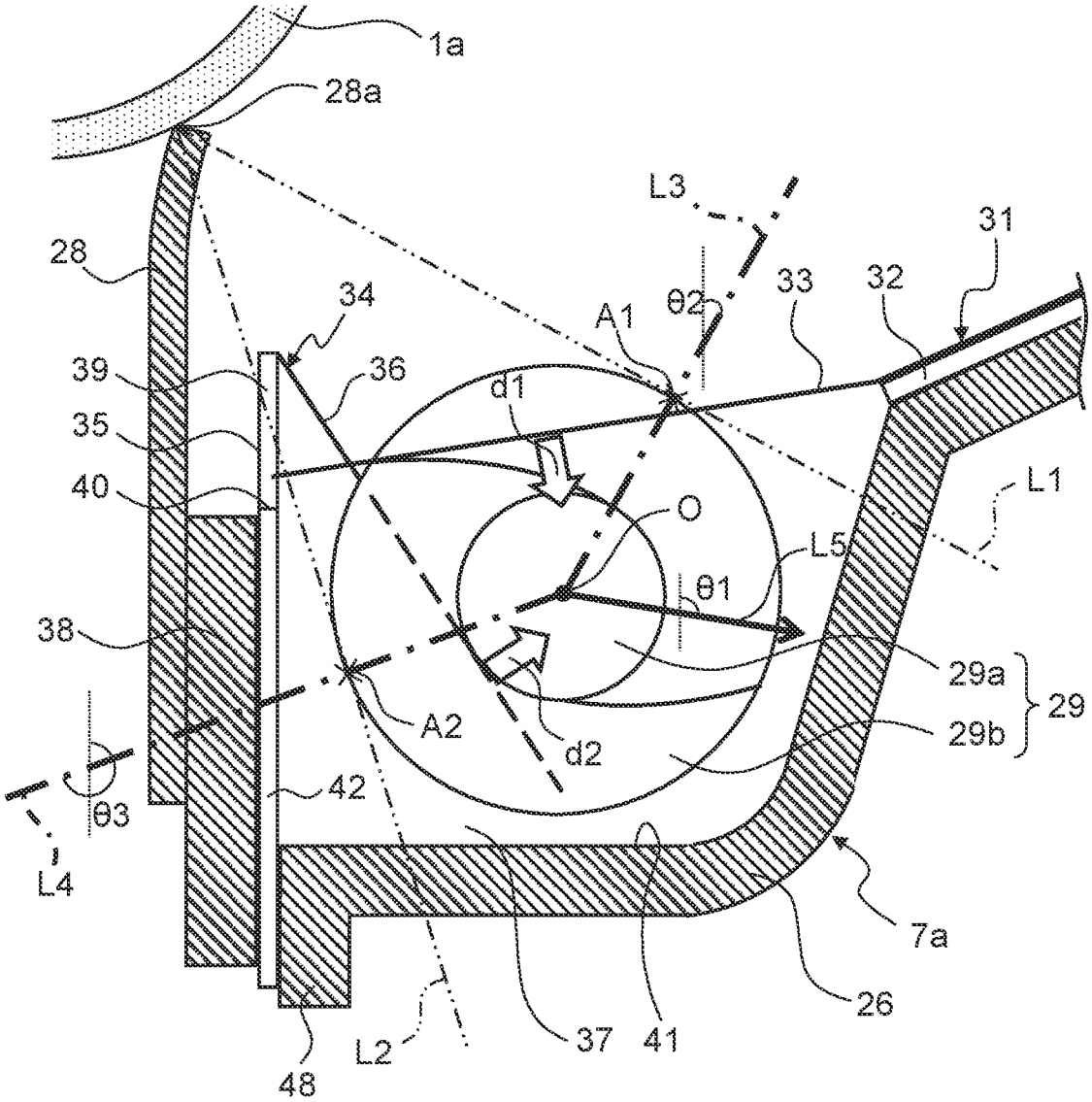
FIG. 4 is a sectional view of a first flicker and a second flicker shown in FIG. 3 as cut in a direction orthogonal to an axis direction.

FIG. 2 is an enlarged view of a vicinity of the image forming portion Pa shown in FIG. 1. FIG. 3 is a side sectional view showing a configuration of surroundings of the cleaning device 7*a* according to the embodiment of the present disclosure shown in FIG. 2. FIG. 4 is a sectional view of a first flicker 31 and a second flicker 34 shown in FIG. 3 as cut in a direction orthogonal to an axis direction. The following describes in detail the image forming portion Pa including the photosensitive drum 1*a*, the charging device 2*a*, and the cleaning device 7*a*. The image forming portions Pd to Pd are similar in configuration to the image forming portion Pa, and thus descriptions thereof are omitted, while components in common are denoted by identical reference signs.

As shown in FIG. 2, around the photosensitive drum 1*a*, there are provided the charging device 2*a*, the developing device 3*a*, and the cleaning device 7*a* along a drum rotation direction (a clockwise direction in FIG. 2), and the primary transfer roller Ca is disposed to face the photosensitive drum 1*a* via the intermediate transfer belt 8. Furthermore, the belt cleaning unit 19 is disposed on an upstream side in a rotation direction of the intermediate transfer belt 8 with respect to the photosensitive drum 1*a*. The belt cleaning unit 19 is opposed to a tension roller 11 via the intermediate transfer belt 8.

The photosensitive drum 1*a* includes an aluminum drum tube and a photosensitive layer stacked on an outer circumferential surface of the drum tube. As the photosensitive layer, there is used, for example, an organic photosensitive layer (OPC) using an organic photoconductor or an inorganic photosensitive layer such as an amorphous silicon (a-Si) photosensitive layer formed by evaporation of silane gas or the like.

The charging device 2*a* includes the charging roller 21 and a brush roller 22. The charging roller 21 makes contact with the photosensitive drum 1*a* to apply a charging bias to a drum surface thereof. The brush roller 22 performs cleaning of the charging roller 21.

The developing device 3*a* includes, in a developing container 20, two stirring conveyance members composed of a stirring conveyance screw 23 and a supply conveyance screw 24, and the developing roller 25. The developing device 3*a* causes toner carried on a surface of the developing roller 25 to fly to the surface of the photosensitive drum 1*a* so that the toner is used to develop an electrostatic latent image into a toner image.

As shown in FIG. 2 and FIG. 3, the cleaning device 7*a* includes a housing 26 and a toner conveyance path 37, and the housing 26 houses therein a rubbing roller 27, the cleaning blade 28, a conveyance screw 29, the first flicker 31, and the second flicker 34. The housing 26 is adjacent to the photosensitive drum 1*a* in a horizontal direction and has an opening 30 formed at a location of the adjacency to the photosensitive drum 1*a*. The toner conveyance path 37 is formed in a bottom part of the housing 26. The toner conveyance path 37 contains waste toner introduced through the opening 30.

The rubbing roller 27 is rotatably and axially supported to side plates (not shown) of the housing 26 in a front-rear direction thereof (a direction perpendicular to a paper plane of FIG. 3). The rubbing roller 27 abuts on the surface (an outer circumferential surface) of the photosensitive drum 1*a* via the opening 30. By an unshorn driver, the rubbing roller 27 is driven to rotate in an identical direction (a following direction) with respect to the photosensitive drum 1*a* on a surface thereof on which it abuts on the photosensitive drum 1*a*. The rubbing roller 27 is driven to rotate in this manner, thus removing residual toner on the surface of the photosensitive drum 1*a* and also rubbing and polishing the surface of the photosensitive drum Ta. The residual toner removed by the rubbing roller 27 is introduced as waste toner into the toner conveyance path 37 in the housing 26 through the opening 30.

The rubbing roller 27 is controlled to have a linear velocity higher (for example, by a factor of 1.2) than a linear velocity of the photosensitive drum 1*a*. The rubbing roller 27 has, for example, a structure including a metal shaft around which a foam layer of EPDM rubber having an Asker C hardness of 55° is formed as a roller body. The roller body is not limited in material to EPDM rubber and may be made of any other type of rubber or formed of a foamed rubber body. Favorably used is a material having an Asker C hardness in a range of 10° to 90°.

As shown in FIG. 3 and FIG. 4, among a plurality of walls constituting the housing 26, a blade securing wall 38 rises up from a side end part of a bottom surface 41 of the toner conveyance path 37 on a side near the photosensitive drum 1*a* in the horizontal direction. The cleaning blade 28 is secured to the blade securing wall 38. The cleaning blade 28 protrudes from the blade securing wall 38 toward the opening 30.

A distal end part 28*a* of the cleaning blade 28 is in contact with the outer circumferential surface of the photosensitive drum 1*a* while being pressed thereagainst. As the photosensitive drum 1*a* rotates, toner on the outer circumferential surface of the photosensitive drum 1*a* is scraped off by the distal end part 28*a* of the cleaning blade 28, The distal end part 28*a* of the cleaning blade 28 is positioned on a downstream side of an abutment portion between the photosensitive drum 1*a* and the rubbing roller 27 in the rotation direction of the photosensitive drum 1*a* (a clockwise direction in FIG. 3).

As the cleaning blade 28, there is used, for example, a polyurethane rubber blade having a JIS hardness of 78° and a thickness of 2 mm. A material, hardness, and dimensions of the cleaning blade 28, a mounting angle thereof with respect to the photosensitive drum 1*a*, a biting amount thereof into the photosensitive drum 1*a*, a pressure contact force against the photosensitive drum 1*a*, and so on are set appropriately depending on specifications of the photosensitive drum 1*a*.

The conveyance screw 29 includes a rotary shaft 29*a* and a helical vane 29*h*. The rotary shaft 29*a* is disposed in the toner conveyance path 37. The rotary shaft 29*a* is rotatably supported to the side plates of the housing 26 in the front-rear direction. The helical vane 29*b* is a spiral-shaped vane integrally formed on an outer circumferential surface of the rotary shaft 29*a*, As the conveyance screw 29 rotates, waste toner contained in the toner conveyance path 37 is conveyed in the axis direction (a direction along the rotary shaft 29*a*) to be discharged to outside the cleaning device 7*a*.

Here, as shown in FIG. 4, among tangents to the conveyance screw 29, tangents L1 (a first tangent) and L2 (a second tangent) are defined as a pair of tangents passing through the distal end part 28*a* of the cleaning blade 28. Waste toner scraped off from the outer circumferential surface of the photosensitive drum 1*a* by the distal end part 28*a* of the cleaning blade 28 passes between the pair of tangents L1 and L2 to be introduced into the toner conveyance path 37.

Figure 5:
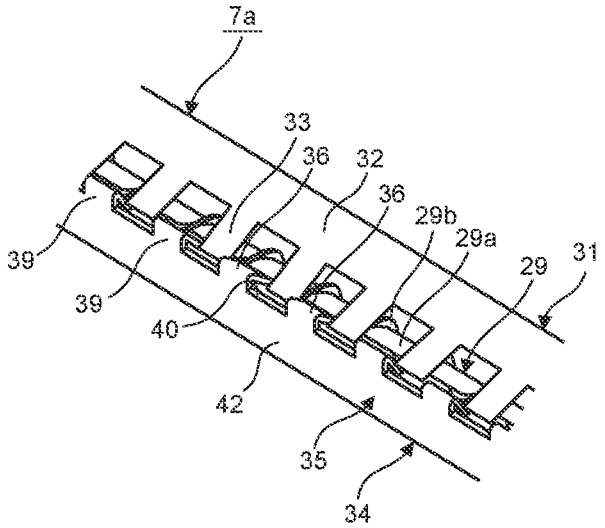
FIG. 5 is a perspective view showing surroundings of a conveyance screw in the cleaning device of the embodiment.
Figure 6:
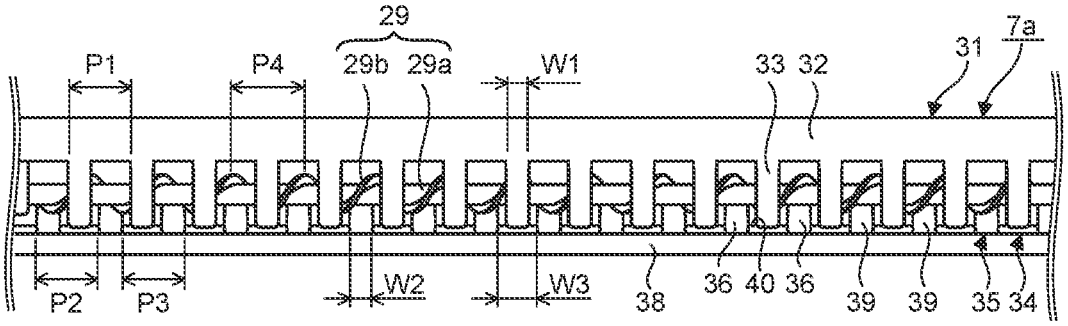
FIG. 6 is a plan view of the surroundings of the conveyance screw in the cleaning device of the embodiment when viewed planarly in a radial direction (a perpendicular direction to a rotary shaft 29*a*).

FIG. 5 is a perspective view showing surroundings of the conveyance screw 29 in the cleaning device 7*a* of the embodiment. FIG. 6 is a plan view of the surroundings of the conveyance screw 29 in the cleaning device 7*a* of the embodiment when viewed planarly in a radial direction (a perpendicular direction to the rotary shaft 29*a*).

As shown in FIG. 4, FIG. 5, and FIG. 6, the first flicker 31 includes a first base portion 32 and a plurality of first contact pieces 33. The first base portion 32 extends in the axis direction parallel to the rotary shaft 29*a* of the conveyance screw 29. At a position opposed to the cleaning blade 28 via the rotary shaft 29*a* in the horizontal direction, the first base portion 32 is secured with an adhesive or the like to an upper part of an inner wall of the housing 26 relative to the rotary shaft 29*a*. The first contact pieces 33 extend from the first base portion 32 toward the conveyance screw 29.

The second flicker 34 includes a second base portion 35 and a plurality of second contact pieces 36. The second base portion 35 extends in the axis direction parallel to the rotary shaft 29*a* of the conveyance screw 29. The second contact pieces 36 extend from the second base portion 35 toward the conveyance screw 29.

The second base portion 35 includes a secured portion 42, a plurality of protrusions 39, and a plurality of waste toner passing concaves 40. The secured portion 42 is secured to an inner wall of the housing 26. The secured portion 42 is positioned between the rotary shaft 29*a* and the cleaning blade 28 together with the opening 30 in the horizontal direction. The secured portion 42 is stacked on a face of the blade securing wall 38 near the toner conveyance path 37. A lower end part of the secured portion 42 is secured with a securing means such as an adhesive to a flicker securing portion 48 protruding downward from a lower end part of the housing 26. The securing means is not limited to an adhesive, and, for example, the lower end part of the secured portion 42 may be held between the blade securing wall 38 and the flicker securing portion 48 and secured with a fastening member such as a bolt.

The protrusions 39 are connected to the secured portion 42. The protrusions 39 are provided at given intervals along the axis direction and protrude from an upper end of the secured portion 42 toward the opening 30. Upper end parts (distal end parts in a protruding direction) of the protrusions 39 are positioned in a region interposed between the above-described tangents L1 and L2 to the conveyance screw 29 (see FIG. 4). The plurality of second contact pieces 36 extend from the distal end parts of the protrusions 39 toward the conveyance screw 29.

As shown in FIG. 4, FIG. 5, and FIG. 6, the plurality of waste toner passing concaves 40 are formed in the second base portion 35 along the axis direction. The waste toner passing concaves 40 are concaved downward from the upper end parts of the protrusions 39 to an outer side of the region interposed between the tangents L1 and L2 (see FIG. 4).

The second contact pieces 36 are connected to the upper end parts of the protrusions 39 and are bent downward therefrom to extend toward an outer circumferential surface of the conveyance screw 29. The second contact pieces 36 are provided over an entire region of the conveyance screw 29 in the axis direction (see FIG. 6). The second contact pieces 36 have a thickness substantially equal to that of the first contact pieces 33. The above-described waste toner passing concaves 40 are each formed between every adjacent pair of the second contact pieces 36 (see FIG. 5 and FIG. 6).

An interval P1 at which the first contact pieces 33 are arranged, an interval P2 at which the second contact pieces 36 are arranged, and an interval P3 at which the waste toner passing concaves 40 are arranged are substantially equal to one another (see FIG. 6). The first contact pieces 33 and the second contact pieces 36 are alternately arranged along the axis direction so as not to overlap each other. The first contact pieces 33 are opposed to the waste toner passing concaves 40 in a direction orthogonal to the rotary shaft 29*a* (an up-down direction shown in FIG. 6).

A width W1 (a length in an extending direction of the first base portion 32) of the first contact pieces 33 and a width W2 (a length in an extending direction of the second base portion 35) of the second contact pieces 36 are substantially equal to each other. The width W1 of the first contact pieces 33 and the width W2 of the second contact pieces 36 are each not more than a pitch P4 of the helical vane 29*b*. Preferably, the width W1 of the first contact pieces 33 has a specific size of, for example, not less than ⅕ of the pitch P4 and not more than ½ of the pitch P4 (see FIG. 6). A width W3 of the waste toner passing concaves 40 in the axis direction is larger than the width W1 of the first contact pieces 33.

There is no particular limitation on a material of the first contact pieces 33 and the second contact pieces 36 as long as the material is an elastic material that swings upon contact with the helical vane 29*b* of the conveyance screw 29. As the material, there can be used various types of synthetic resin sheets having a reduced friction resistance such as, for example, a polyethylene terephthalate (PET) sheet, a fluororesin sheet, and a polyimide sheet, among which the polyethylene terephthalate sheet is used preferably in terms of cost, durability, and so on.

As shown in FIG. 4, in a perpendicular direction, at a position nearer to the opening 30 (see FIG. 3) of the housing 26 than the rotary shaft 29*a* is (a position more distant from the bottom surface 41 of the toner conveyance path 37 than the rotary shaft 29 is), the first contact pieces 33 are in contact with an upper part of the conveyance screw 29 relative to the rotary shaft 29*a*. From a position of the contact with the conveyance screw 29, the first contact pieces 33 press the conveyance screw 29 downward along a first direction d1 toward a bottom surface of the housing 26 (the bottom surface 41 of the toner conveyance path 37).

At a position more distant from the opening 30 (see FIG. 3) of the housing 26 than the rotary shaft 29*a* is (a position nearer to the bottom surface 41 of the toner conveyance path 37 than the rotary shaft 29*a* is), the second contact pieces 36 are in contact with a lower part of the conveyance screw 29 relative to the rotary shaft 29*a*, From a position of the contact with the conveyance screw 29, the second contact pieces 36 press the conveyance screw 29 upward along a second direction d2 (a direction away from the bottom surface 41 of the toner conveyance path 37) opposite to the first direction d1.

The first contact pieces 33 and the second contact pieces 36 have free ends at their distal end parts. As the conveyance screw 29 rotates, the first contact pieces 33 and the second contact pieces 36 swing while being elastically deformed so as to repeatedly assume a state of making contact with the helical vane 29*b* and thus being lifted to be elastically deformed and a state of abutting on the rotary shaft 29*a* under resilience.

In a state where the first contact pieces 33 are lifted by the helical vane 29*b*, the distal end parts of the first contact pieces 33 are positioned within the waste toner passing concaves 40 (see FIG. 4). When the first contact pieces 33 are making contact with the rotary shaft 29*a* under resilience, the distal end parts of the first contact pieces 33 are positioned on outer sides of the waste toner passing concaves 40. When the first contact pieces 33 swing in the above-described manner, the first contact pieces 33 repeatedly go in and out of the waste toner passing concaves 40 without making contact with the second flicker 34.

Here, FIG. 4 shows a normal L3, a normal L4, and an action line L5. The normal L3 is a straight line passing through a shaft center O of the rotary shaft 29*a* and a contact point A1 (a contact point between the tangent L1 (a tangent on a side near the first flicker 31) and the conveyance screw 29). The normal L4 is a straight line passing through the shaft center O and a contact point A2 (a contact point between the tangent L2 (a tangent on a side near the second flicker 34) and the conveyance screw 29). The action line L5 is an action line representing a resultant force of a pressing force of the first flicker 31 for pressing the conveyance screw 29 and a pressing force of the second flicker 34 for pressing the conveyance screw 29.

As shown in FIG. 4, an inclination angle (an inclination angle clockwise from a 12 o'clock direction) θ1 of the action line L5 with respect to the perpendicular direction is not less than an inclination angle θ2 of the normal L3 with respect to the perpendicular direction and not more than an inclination angle θ3 of the normal L4 with respect to the perpendicular direction. Furthermore, when an inclination angle in a counterclockwise direction from the 12 o'clock direction is considered, the inclination angle θ1 is not less than the inclination angle θ3 and not more than the inclination angle θ2. That is, the inclination angle θ1 of the action line L5 in a prescribed turn direction with respect to the perpendicular direction has a value between the inclination angle θ2 of the normal L3 with respect to the perpendicular direction and the inclination angle θ3 of the normal L4 with respect to the perpendicular direction.

The action line L5, therefore, is directed in an opposite direction to the distal end part 28*a* of the cleaning blade 28. That is, by the first flicker 31 and the second flicker 34, the conveyance screw 29 is pressed in a direction away from the distal end part 28*a* of the cleaning blade 28. Consequently, even if the conveyance screw 29 is deformed, it is unlikely that a clearance between the conveyance screw 29 and the bottom surface 41 of the toner conveyance path 37 is widened, thus making it possible to suppress occurrence of toner discharge failure.

Meanwhile, there is a conventional cleaning device of a type including two flickers formed to make contact with each other. These flickers are in contact with a conveyance screw at respective positions thereon nearer to distal ends thereof than a location of the contact therebetween is. This has led to a fear that waste toner scraped off from a surface of the conveyance screw might accumulate in a clearance or the like at the location of the contact between the two flickers, causing toner discharge failure such as interference with conveyance of waste toner.

Here, as described above, the first flicker 31 and the second flicker 34 of the cleaning device 7*a* according to the present disclosure are configured so that the first contact pieces 33 and the second contact pieces 36 are individually in contact with the conveyance screw 29 from above and below, respectively. Further, the first contact pieces 33 and the second contact pieces 36 are alternately arranged so as not to overlap in the axis direction and thus are not in contact with each other. Adopting the configuration of the first flicker 31 and the second flicker 34 of this embodiment, therefore, can prevent occurrence of toner discharge failure as caused in a case of a conventional flicker.

Furthermore, as described above, along with the protrusions 39, the plurality of waste toner passing concaves 40 are formed. The waste toner passing concaves 40 are open between the pair of tangents L1 and L2 defining a passage path of waste toner removed from the photosensitive drum 1*a*. This makes it easier for waste toner passing between the pair of tangents L1 and L2 to pass through the waste toner passing concaves 40 to reach the toner conveyance path 37, thus making it possible to suppress a phenomenon in which waste toner is blocked by the protrusions 39 from being introduced into the toner conveyance path 37.

Furthermore, as described above, the first contact pieces 33 are opposed to the waste toner passing concaves 40 in a direction orthogonal to the axis direction and swing to repeatedly go in and out of the waste toner passing concaves 40. Thus, the first flicker 31 can be disposed as closely as possible to the second flicker 34 while not making contact therewith, so that space saving in the toner conveyance path 37 can be achieved.

Other than the above, the present disclosure is not limited to the foregoing embodiment and can be variously modified without departing from the spirit of the present disclosure. For example, while the foregoing embodiment describes only a configuration including the rubbing roller 27 and the cleaning blade 28 as a polishing system in each of the cleaning devices 7*a* to 7*d*, the configuration of the present disclosure is applicable to cleaning devices having various configurations including the conveyance screw 29, such as a configuration including, as the polishing system, only the cleaning blade 28 or a configuration in which the rubbing roller 27 is replaced with a cleaning roller having only a cleaning function.

Furthermore, the interval P1 at which the first contact pieces 33 are arranged may be an interval different from the interval P3 at which the waste toner passing concaves 40 are arranged as long as the first contact pieces 33 are opposed to the waste toner passing concaves 40.

The present disclosure is usable in a cleaning device that removes waste toner from a surface of an image carrier and conveys the waste toner thus removed. Through the use of the present disclosure, it is possible to provide a cleaning device capable of effectively preventing solidification of toner and thus maintaining stable toner conveyance capability and an image forming apparatus including the same.

What is claimed is:

1. A cleaning device, comprising:

a housing having an opening that is formed so as to overlap an outer circumferential surface of an image carrier and through which waste toner removed from the outer circumferential surface of the image carrier is introduced inside the housing;

a cleaning blade that protrudes through the opening toward the outer circumferential surface of the image carrier and has a distal end part that abuts on the outer circumferential surface of the image carrier;

a toner conveyance path that is provided in a bottom part of the housing and conveys the waste toner introduced through the opening;

a conveyance screw that includes:

a rotary shaft rotatably supported inside the toner conveyance path; and a helical vane formed on an outer circumferential surface of the rotary shaft;

a first flicker that includes:

a first base portion extending in a direction of the rotary shaft; and a plurality of first contact pieces extending from the first base portion toward the conveyance screw to abut on an upper part of an outer circumferential surface of the conveyance screw relative to the rotary shaft and arranged along the rotary shaft direction, the first flicker using the first contact pieces to press the conveyance screw in a first direction toward a bottom part of the toner conveyance path; and a second flicker that includes:

a second base portion extending in the rotary shaft direction; and a plurality of second contact pieces extending from the second base portion toward the conveyance screw to abut on a lower part of the outer circumferential surface of the conveyance screw relative to the rotary shaft and arranged along the rotary shaft direction, the second flicker using the second contact pieces to press the conveyance screw in a second direction opposite to the first direction, wherein an inclination angle θ1 of an action line of a resultant force of respective pressing forces of the first flicker and the second flicker with respect to the rotary shaft in a prescribed turn direction with respect to a perpendicular direction has a value between an inclination angle θ2 of a normal, with respect to the perpendicular direction, to a first tangent of a pair of tangents passing through the distal end part of the cleaning blade and the outer circumferential surface of the conveyance screw, the first tangent being on a side near the first flicker, and an inclination angle θ3 of a normal, with respect to the perpendicular direction, to a second tangent of the pair of tangents, the second tangent being on a side near the second flicker.

2. The cleaning device according to claim 1, wherein the first base portion is provided at a position on an opposite side to the opening via the rotary shaft in a horizontal direction, and the second base portion is provided at a position between the rotary shaft and the opening in the horizontal direction.

3. The cleaning device according to claim 1, wherein the first contact pieces and the second contact pieces are alternately arranged along the rotary shaft direction.

4. The cleaning device according to claim 3, wherein the second base portion has a protrusion protruding toward the opening to a region between the pair of tangents, the second contact pieces are each bent from a distal end part of the protrusion in a protruding direction thereof to extend toward the outer circumferential surface of the conveyance screw, a plurality of protrusions are formed, each of the protrusions being identical to the protrusion, so that waste toner passing concaves each concaved from the distal end part of the protrusion in an opposite direction to the protruding direction to an outer side of the region between the pair of tangents are arranged so as to alternate with the second contact pieces along the rotary shaft direction, and a width of the waste toner passing concaves in the rotary shaft direction is larger than a width of the first contact pieces, and the waste toner passing concaves are opposed to the first contact pieces in a direction orthogonal to the rotary shaft direction.

5. An image forming apparatus, comprising:

an image forming portion that transfers toner on the image carrier onto a recording medium so as to form an image thereon; and the cleaning device according to claim 1.

* * * * *